US010822201B2

(12) United States Patent
Rhouzlane et al.

(10) Patent No.: US 10,822,201 B2
(45) Date of Patent: Nov. 3, 2020

(54) ELEVATOR LANDING DOOR UNLOCKING SYSTEM

(71) Applicant: Otis Elevator Company, Farmington, CT (US)

(72) Inventors: Soufyen Rhouzlane, Gien (FR); Valerie Mauguen, Sully sur Loire (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 345 days.

(21) Appl. No.: 15/832,934

(22) Filed: Dec. 6, 2017

(65) Prior Publication Data

US 2018/0186606 A1 Jul. 5, 2018

(30) Foreign Application Priority Data

Dec. 30, 2016 (EP) ..... 16306856

(51) Int. Cl.
*B66B 13/20* (2006.01)
*B66B 13/06* (2006.01)
*B66B 13/24* (2006.01)

(52) U.S. Cl.
CPC ..... *B66B 13/20* (2013.01); *B66B 13/06* (2013.01); *B66B 13/245* (2013.01)

(58) Field of Classification Search
CPC ..... B66B 13/20; B66B 13/245
See application file for complete search history.

(56) References Cited

U.S. PATENT DOCUMENTS

| | | | | |
|---|---|---|---|---|
| 1,950,150 | A | 3/1934 | Norton et al. | |
| 4,483,420 | A * | 11/1984 | Byrne | B66B 13/20 187/280 |
| 4,947,964 | A | 8/1990 | Husmann | |
| 7,650,971 | B2 | 1/2010 | Pillin et al. | |
| 8,162,108 | B2 | 4/2012 | Sirigu et al. | |
| 2005/0145442 | A1 * | 7/2005 | Cocher | B66B 13/20 187/333 |
| 2015/0321882 | A1 | 11/2015 | Pursiainen et al. | |

FOREIGN PATENT DOCUMENTS

| | | |
|---|---|---|
| CN | 2672012 | 1/2005 |
| CN | 202464974 | 10/2012 |
| CN | 103612966 | 3/2014 |
| CN | 204549768 | 8/2015 |
| CN | 205367429 U | 7/2016 |

(Continued)

OTHER PUBLICATIONS

European Search Report, European Application No. 16306856.2, dated Jun. 27, 2017; European Search Report 12 pages.

*Primary Examiner* — Diem M Tran
(74) *Attorney, Agent, or Firm* — Cantor Colburn LLP

(57) ABSTRACT

Elevator landing door lock assemblies and elevator landing doors having a lock with a keyway accessible from a landing of an elevator system, the lock operable to lock and unlock a landing door and a disengageable link operably connected to the lock and configured to prevent unlocking of the landing door when the disengageable link is not engaged. When an elevator car is aligned with the landing door, the disengageble link is engaged and completed such that the lock is operable to unlock and open the landing door, and, when an elevator car is not aligned with the landing door, the lock is not operable.

12 Claims, 7 Drawing Sheets

(56) References Cited

FOREIGN PATENT DOCUMENTS

| | | | |
|---|---|---|---|
| EP | 0506155 | | 9/1992 |
| EP | 1400480 | A1 | 3/2004 |
| EP | 1440930 | | 7/2004 |
| JP | H072473 | | 1/1995 |
| WO | 2005090218 | A1 | 9/2005 |
| WO | 2016092337 | A1 | 6/2016 |

* cited by examiner

ELEVATOR LANDING DOOR UNLOCKING SYSTEM

CROSS-REFERENCE TO RELATED APPLICATIONS

This application claims the benefit of European Application No. 16306856.2 filed on Dec. 30, 2016, which is incorporated herein by reference in its entirety.

BACKGROUND

The subject matter disclosed herein generally relates to elevator systems and, more particularly, to systems for unlocking elevator landing doors.

In a typical elevator or lift installation, a vertically moving elevator car can be positioned at one of a number of landing floors so as to align elevator car doors with corresponding landing doors located at one of the landings. Modern installations typically have one or more horizontally sliding elevator car doors and at least one sliding landing door located at each of the landing floors, all of which remain closed during movement of the elevator car.

Upon arrival of the elevator car at a landing, a door opening mechanism is activated which drives the elevator car door horizontally to open the elevator car door. In typical installations, a door coupling employing one or more vanes projecting from the surface of the elevator car door in the direction of the adjacent landing door engages various structures of the landing door. For example vanes, rollers, or other protrusions can be configured to project from the landing door to enable engagement and/or coupling between the elevator car door and the landing door. Through the engagement and/or coupling, the elevator car door drives the landing door horizontally open. As such, passengers can enter or exit the elevator car.

Elevator codes and regulations may require that the landing doors remain locked and fastened securely to prevent opening and thereby prevent unauthorized opening unless an elevator car is positioned directly adjacent the landing (e.g., engagement/coupling of doors). Further, elevator car doors may be required to remain latched against manual movement unless the elevator car is positioned at a landing, and the doors are aligned (e.g., detected alignment) and/or engaged/coupled. Various mechanisms and systems have been employed to secure and unsecure landing and elevator car doors. It may be advantageous to provide secure mechanisms to enable locking/unlocking the elevator system doors while also providing safety measures to prevent opening under unauthorized and/or unsafe opening conditions (e.g., elevator car not present at landing).

SUMMARY

According to some embodiments, elevator landing door lock assemblies are provided. The elevator landing door locks include a lock having a keyway accessible from a landing of an elevator system, the lock operable to lock and unlock a landing door and a disengageable link operably connected to the lock and configured to prevent unlocking of the landing door when the disengageable link is not engaged. When an elevator car is aligned with the landing door, the disengageble link is engaged and completed such that the lock is operable to unlock and open the landing door, and when an elevator car is not aligned with the landing door, the lock is not operable.

In addition to one or more of the features described herein, or as an alternative, further embodiments of the elevator landing door lock assemblies may include that the disengageable link is an actuator arm operably connected to the lock such that rotation of a key within the keyway actuates the actuator arm.

In addition to one or more of the features described herein, or as an alternative, further embodiments of the elevator landing door lock assemblies may include that actuation of the actuator arm urges a portion of an elevator car door coupling into contact with a landing door coupling to enable opening of the landing door.

In addition to one or more of the features described herein, or as an alternative, further embodiments of the elevator landing door lock assemblies may include that the actuator arm is a lever that contacts a vane of the elevator car door coupling.

In addition to one or more of the features described herein, or as an alternative, further embodiments of the elevator landing door lock assemblies may include a landing door coupling positioned away from the lock and configured to operate through contact from a portion of the elevator car door coupling.

In addition to one or more of the features described herein, or as an alternative, further embodiments of the elevator landing door lock assemblies may include that the landing door coupling comprises one or more rollers configured to engage with the portion of the elevator car door coupling.

In addition to one or more of the features described herein, or as an alternative, further embodiments of the elevator landing door lock assemblies may include that the actuation of the actuator arm comprises a rotational movement.

According to some embodiments, elevator systems are provided. The elevator systems include an elevator car located within an elevator shaft, a landing having a landing door openable on the elevator shaft, and a landing door lock assembly. The landing door lock assembly includes a lock having a keyway accessible from the landing and located within the elevator shaft, and a disengageable link operably connected to the lock and configured to prevent unlocking of the landing door when the disengageable link is not engaged, wherein, when an elevator car is aligned with the landing door, the disengageble link is engaged and completed such that the lock is operable to unlock and open the landing door, and wherein, when an elevator car is not aligned with the landing door, the lock is not operable.

In addition to one or more of the features described herein, or as an alternative, further embodiments of the elevator systems may include that the disengageable link is an actuator arm operably connected to the lock such that rotation of a key within the keyway actuates the actuator arm.

In addition to one or more of the features described herein, or as an alternative, further embodiments of the elevator systems may include that actuation of the actuator arm urges a portion of an elevator car door coupling into contact with a landing door coupling to enable opening of the landing door.

In addition to one or more of the features described herein, or as an alternative, further embodiments of the elevator systems may include that the actuator arm is a lever that contacts a vane of the elevator car door coupling.

In addition to one or more of the features described herein, or as an alternative, further embodiments of the elevator systems may include a landing door coupling positioned within the elevator shaft and away from the lock, the landing door coupling configured to operate through contact from a portion of the elevator car door coupling.

In addition to one or more of the features described herein, or as an alternative, further embodiments of the elevator systems may include that the landing door coupling comprises one or more rollers configured to engage with the portion of the elevator car door coupling.

In addition to one or more of the features described herein, or as an alternative, further embodiments of the elevator systems may include that the actuation of the actuator arm comprises a rotational movement.

Technical effects of embodiments of the present disclosure include systems and devices for preventing opening elevator landing door(s) unless an elevator car is located at the landing. Further technical effects include a lock and a disengageable link, such as an actuator arm, configured such that the disengageable link engages with a portion of an elevator car door coupling to enable opening of the elevator car door and a respective landing door.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
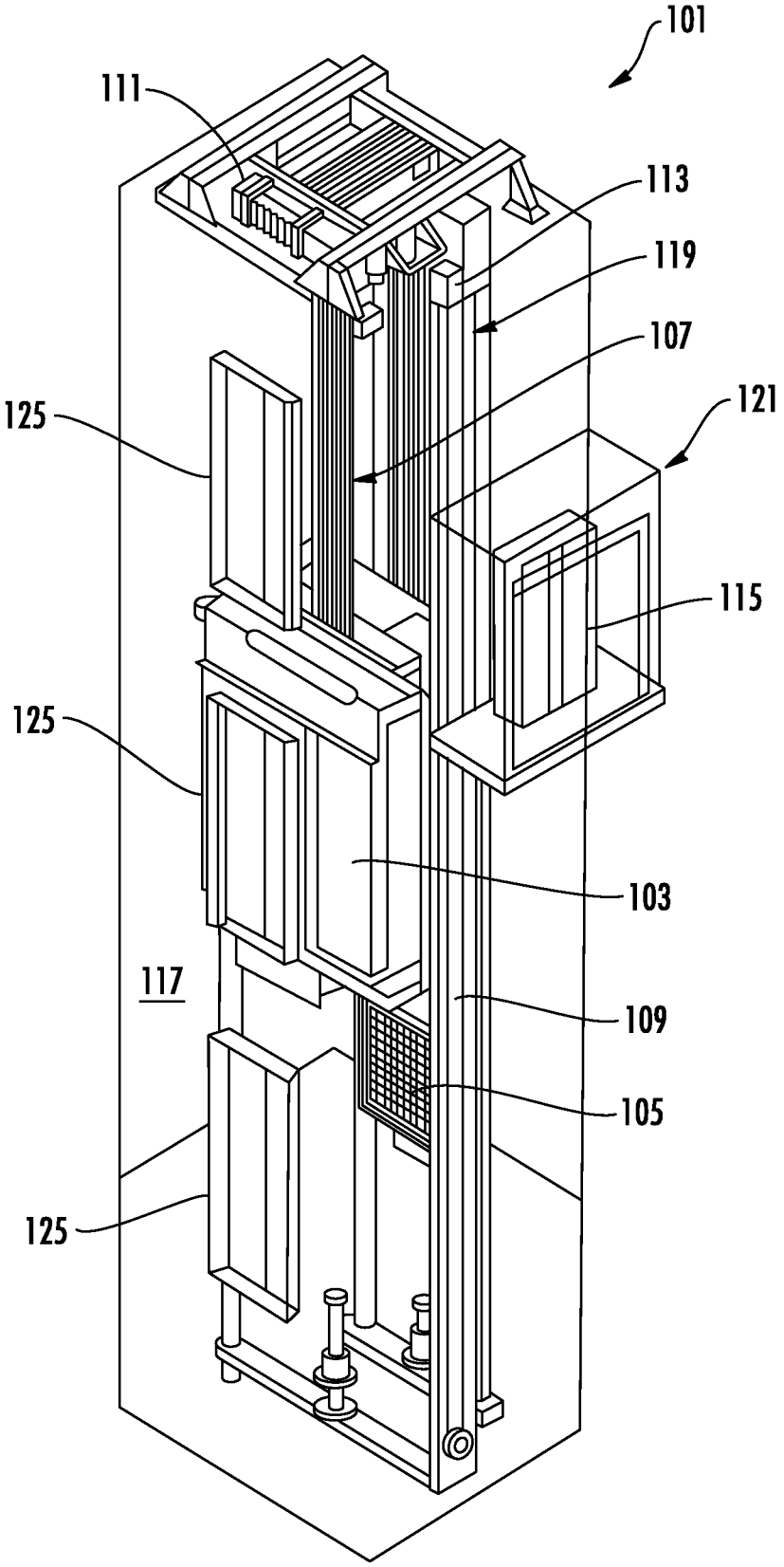
FIG. 1 is a schematic illustration of an elevator system that may employ various embodiments of the present disclosure.

As shown and described herein, various features of the disclosure will be presented. Various embodiments may have the same or similar features and thus the same or similar features may be labeled with the same reference numeral, but preceded by a different first number indicating the figure in which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a perspective view of an elevator system 101 including an elevator car 103, a counterweight 105, one or more load bearing members 107, a guide rail 109, a machine 111, a position encoder 113, and an elevator controller 115. The elevator car 103 and counterweight 105 are connected to each other by the load bearing members 107. The load bearing members 107 may be, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The load bearing members 107 engage the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The elevator controller 115 is located, as shown, in a controller room 121 of the elevator shaft 117 and is configured to control the operation of the elevator system 101, and particularly the elevator car 103. For example, the elevator controller 115 may provide drive signals to the machine 111 to control the acceleration, deceleration, leveling, stopping, etc. of the elevator car 103. The elevator controller 115 may also be configured to receive position signals from the position encoder 113. When moving up or down within the elevator shaft 117 along guide rail 109, the elevator car 103 may stop at one or more landings 125 as controlled by the elevator controller 115. Although shown in a controller room 121, those of skill in the art will appreciate that the elevator controller 115 can be located and/or configured in other locations or positions within the elevator system 101. In some embodiments, the elevator controller 115 can be configured to control features within the elevator car 103, including, but not limited to, lighting, display screens, music, spoken audio words, etc.

The machine 111 may include a motor or similar driving mechanism and an optional braking system. In accordance with embodiments of the disclosure, the machine 111 is configured to include an electrically driven motor. The power supply for the motor may be any power source, including a power grid, which, in combination with other components, is supplied to the motor. Although shown and described with a rope-based load bearing system, elevator systems that employ other methods and mechanisms of moving an elevator car within an elevator shaft may employ embodiments of the present disclosure. FIG. 1 is merely a non-limiting example presented for illustrative and explanatory purposes.

Figure 2A:
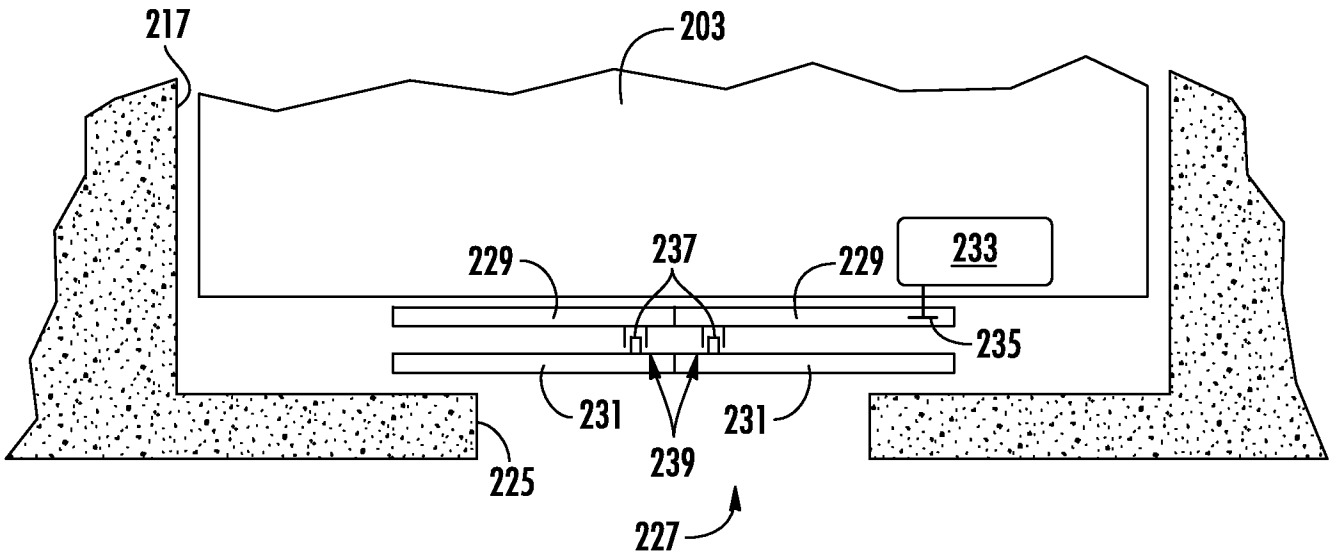
FIG. 2A is a schematic, partial plan view of an elevator car in an elevator shaft with elevator car doors and landing doors in a closed position.
Figure 2B:
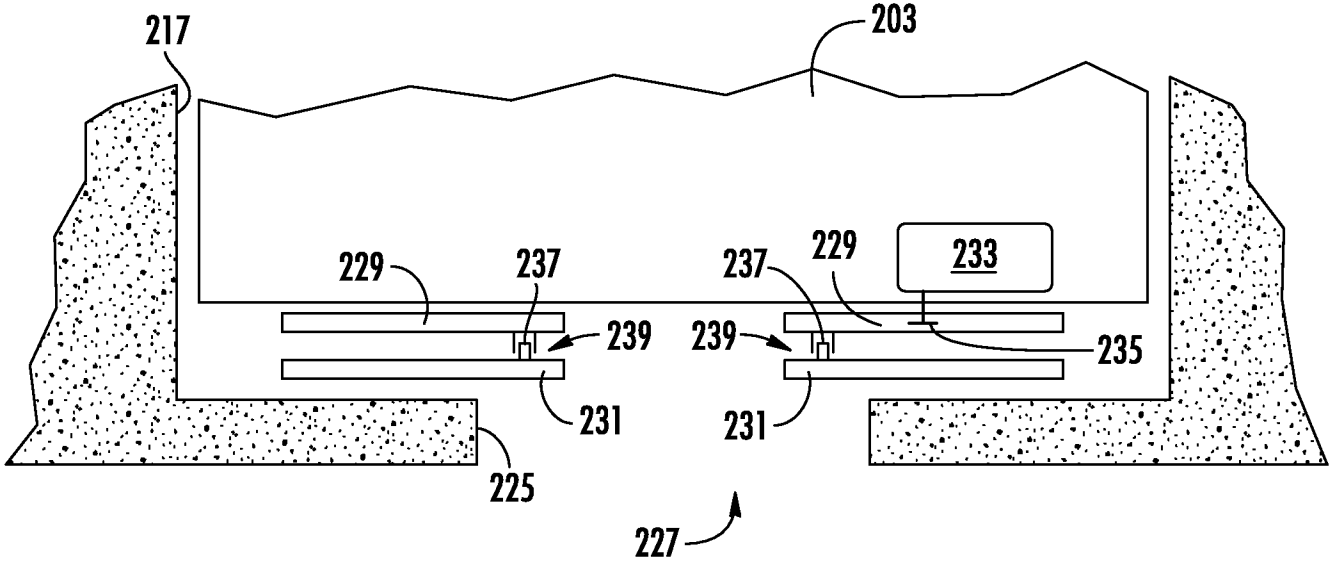
FIG. 2B is a schematic illustration of the elevator car and landing doors of FIG. 2A shown in an open position.

Turning to FIGS. 2A-2B, partial plan view illustrations of operation of elevator doors of an elevator system are shown. In FIGS. 2A-2B, an elevator car 203 is located within an elevator shaft 217 and positioned within the elevator shaft 217 in alignment with an opening 227 at a landing 225. As shown, elevator car doors 229 are aligned with landing doors 231 at the landing 225. The elevator car doors 229 are operated and actuated by a door operator 233. The door operator 233 can be in operable communication with a controller (e.g., elevator controller 115). The door operator 233, in the present embodiment, is shown located atop the elevator car 203, although other locations of the door operator 233 can be employed without departing from the scope of the present disclosure. The door operator 233 includes a drive mechanism 235, such as a belt or chain operably driven by a motor or other device. FIG. 2A illustrates the elevator car doors 229 and the landing doors 231 in a closed position. FIG. 2B illustrates the elevator car doors 229 and the landing doors 231 in a partially opened position.

As shown in FIGS. 2A-2B, each elevator car door 229 is coupled to a respective landing door 231 by an elevator car door coupling 239 that is part of or mounted to the respective elevator car door 229. Each elevator car door coupling 239 engages with and couples to a corresponding landing door coupling 237. As will be appreciated by those of skill in the art, the landing door couplings 237 can be configured as protrusions or other structures that are designed to engage with the elevator car door couplings 239. The landing door couplings 237, for example, can be raised bosses, bumpers, rods, rollers, etc., that are configured to act upon and move the respective landing door 231 concurrently with operation of the elevator car doors 229 through engagement of the couplings 237, 239. As will be appreciated by those skilled in the art, it is desirable that the elevator car door coupling 239 firmly/tightly grip a respective the landing door coupling 237 when the elevator car door 229 and the landing door 231 are operated (e.g., opened/closed simultaneously). Furthermore, it is desirable that the elevator car door coupling 239 completely release the respective landing door coupling 237 and maintain sufficient running clearance as the elevator car 203 moves vertically through the elevator shaft 217. The elevator car door coupling 239 is configured to operate only when it has been determined that the elevator car 203 is positioned within a landing door zone, adjacent a respective landing door 231 at a landing 225.

During emergency situations, such as power loss or similar events, it may be necessary for rescue or emergency personnel to open the elevator landing doors to aid in a rescue operation. Accordingly, it is possible to manually unlock the landing door lock using a mechanism actuated by a triangular key, as known in the art. However, this unlocking operation is possible regardless of the position of the elevator car. That is, in some instances, the elevator landing doors may be openable when an elevator car is not present and adjacent the elevator landing doors. Such situation may be dangerous and thus preventing such access and operation of the landing doors when the car is not present may be advantageous.

Accordingly, embodiments provided herein are directed to apparatuses, systems, and methods directed to elevator landing door locking/unlocking mechanisms that are designed to enable opening of landing doors only when an elevator car is present at the particular landing. That is, embodiments provided herein are directed to landing door locking mechanisms that do not enable opening of the landing doors unless there is an elevator car present at the landing doors. In the event of an emergency, with such mechanisms, the emergency personnel can move an elevator car to a desired landing and then unlock and open the elevator doors (landing doors and elevator car doors).

Figure 3B:
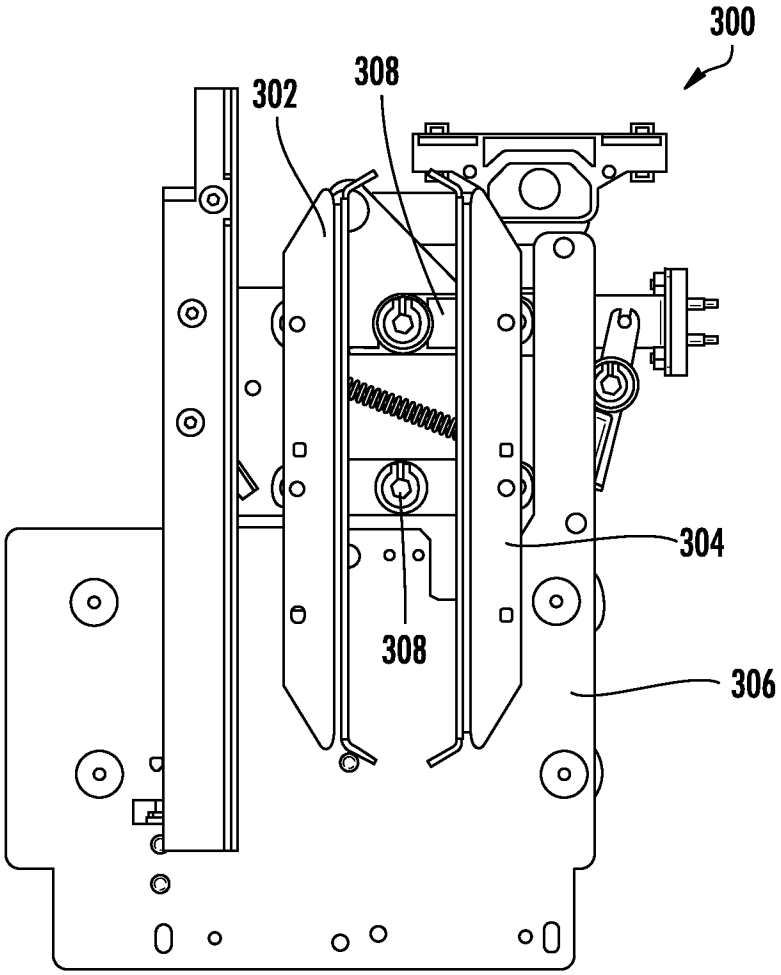
FIG. 3B is a schematic illustration of the elevator car door coupling of FIG. 3A in an open state.
Figure 3A:
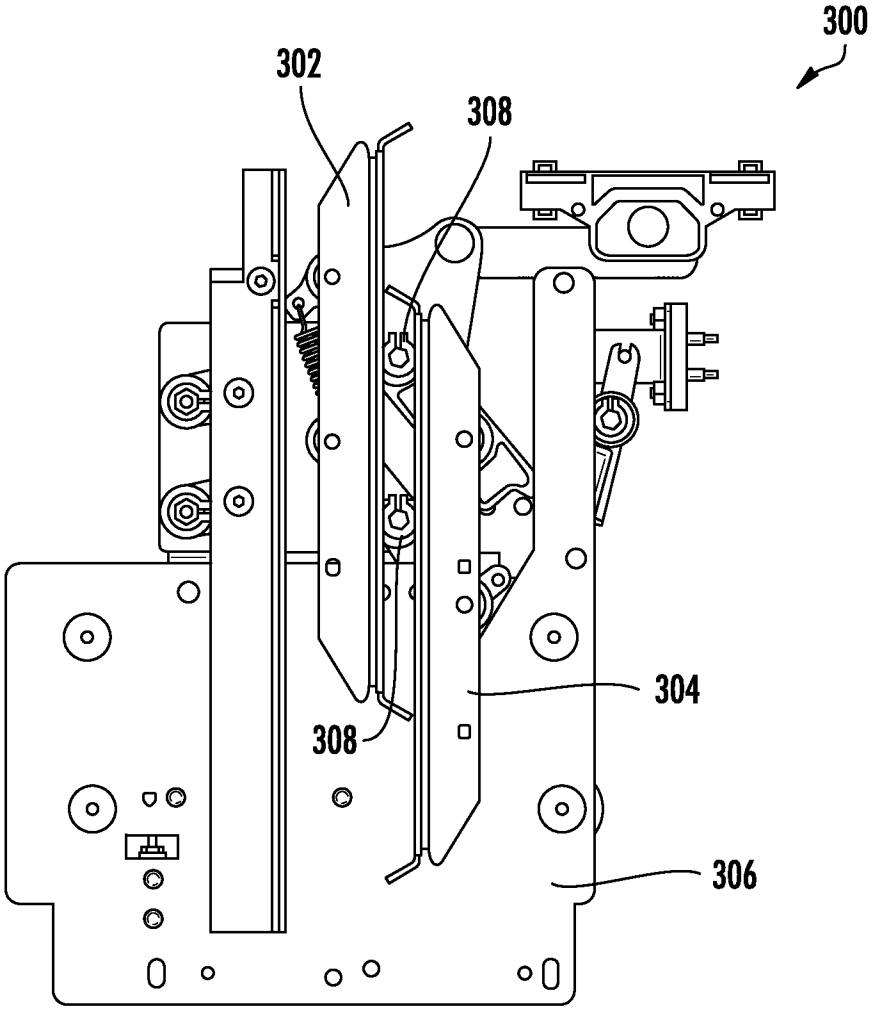
FIG. 3A is a schematic illustration of an elevator car door coupling shown in a closed state.

Turning now to FIGS. 3A-3B, schematic illustrations of an elevator car door coupling 300 are shown, with FIG. 3A illustrating a closed position and FIG. 3B illustrating an open position. The elevator car door coupling 300 is mounted to an exterior surface of an elevator car door and travels with the elevator car as the elevator car moves within an elevator shaft. The elevator car door coupling 300 is engageable with a landing door coupling (not shown), and, when engaged, enables opening of the elevator car doors and the landing doors (e.g., as shown in FIGS. 2A-2B). When the elevator car is traveling within the elevator shaft, the elevator car door coupling 300 is in the closed position (FIG. 3A) and is configured to prevent contact between the elevator car door coupling 300 and landing door couplings located at each landing.

FIGS. 3A-3B illustrate the elevator car door coupling 300 as it would appear viewed in elevation when a corresponding elevator car door is in the fully closed position. The elevator car door coupling 300, as shown, includes a first vane 302 and a second vane 304. The first and second vanes 302, 304 are positioned proximate rollers of a landing door coupling when the landing door is also fully closed, as will be appreciated by those of skill in the art. The first and second vanes 302, 304 are movable relative to a support 306 mounted to the elevator car. The first and second vanes 302, 304 are movable about a pair of pivoting links 308.

When disposed in the orientation as shown in FIG. 3A (closed position), the elevator car door coupling 300 permits vertical movement of the elevator car within the elevator shaft without interference with the landing door couplings. That is, the first and second vanes 302, 304 are positioned such that rollers or other elements of the landing door couplings of the landings may be passed easily without danger of interference or contact.

In contrast, FIG. 3B illustrates the elevator car door coupling 300 as it appears during normal opening operation of an elevator car door when positioned relative to a landing door (e.g., coupled to a landing door coupling). As can be seen in FIG. 3B (as compared to FIG. 3A), the first and second vanes 302, 304 are moved away from each other and will contact rollers of a landing door coupling (not shown), as known in the art.

In traditional elevator car/landing door coupling configurations, it may be possible to manually unlock the landing door coupling using a mechanism actuated by a triangular key that is inserted from the landing. Such traditional coupling configurations may be unlocked even if the car is not present at the particular landing. That is, the landing doors can be unlocked, opened, and access can be granted to the elevator shaft, even if an elevator car is not present at the landing. Such access can be dangerous, and thus preventing such access is desirable. However, enabling emergency personnel to open the landing doors, such as during rescue operations, is also desirable.

Accordingly, embodiments provided herein are directed to landing door unlocking devices that prevent opening of the landing doors when an elevator car is not present, and enable unlocking only when an elevator car is present. That is, features provided in accordance with embodiments of the present disclosure are directed to structures that ensure an elevator car is present to enable operation of the unlocking mechanism.

For example, turning now to FIGS. 4A-4D, schematic illustrations of an elevator landing door lock assembly 410 in accordance with an embodiment of the present disclosure are shown. The elevator landing door lock assembly 410 is a locking mechanism that has a keyway accessible from a landing. The keyway enables insertion of a key, such as a triangular key, into the elevator landing door lock assembly 410 and actuation of the elevator landing door lock assembly 410. Actuation of the elevator landing door lock assembly 410 enables unlocking of a landing door 431 which then enables opening of the landing door 431.

Figure 4A:
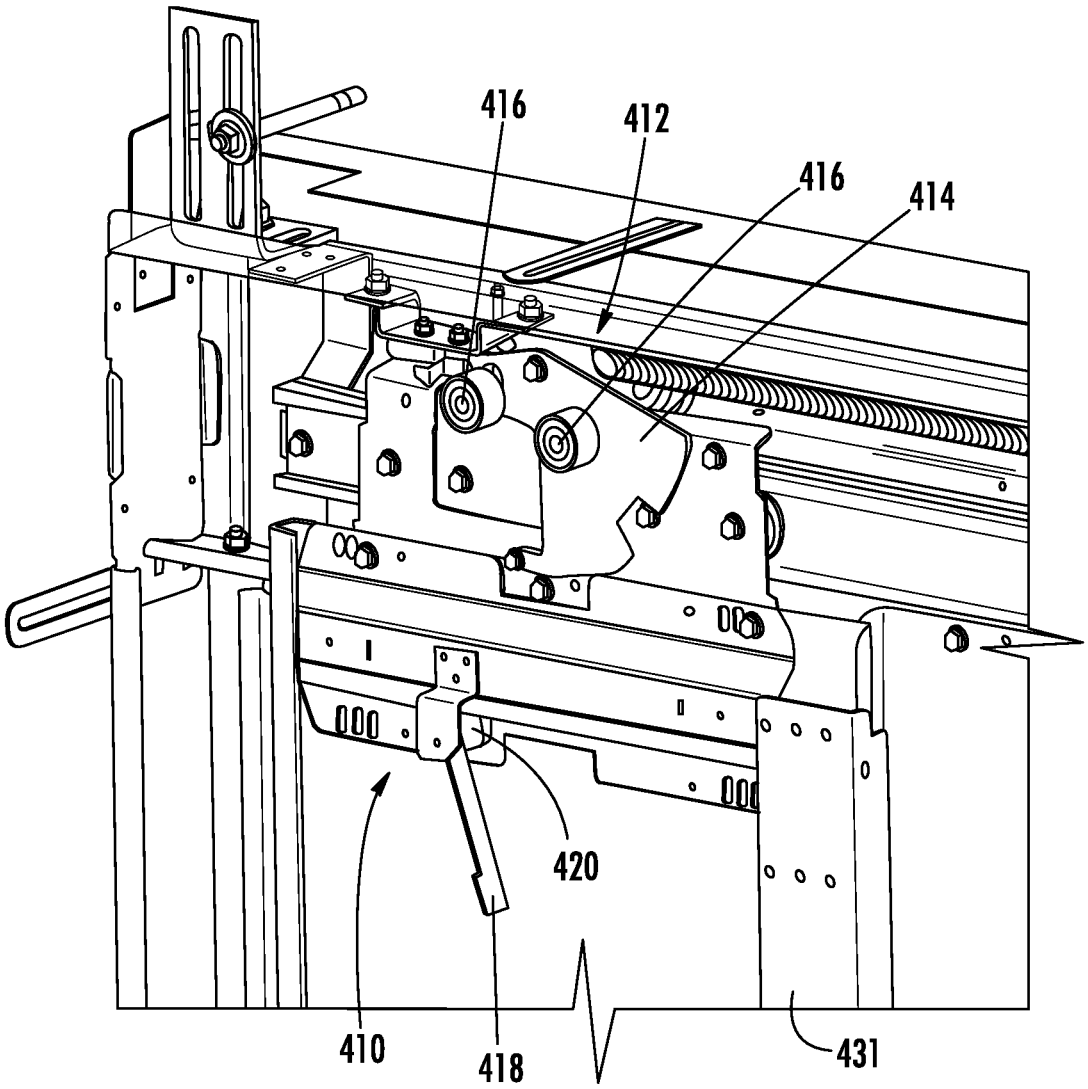
FIG. 4A is a schematic illustration of an elevator landing door lock assembly in accordance with an embodiment of the present disclosure, with no elevator car present.
Figure 4B:
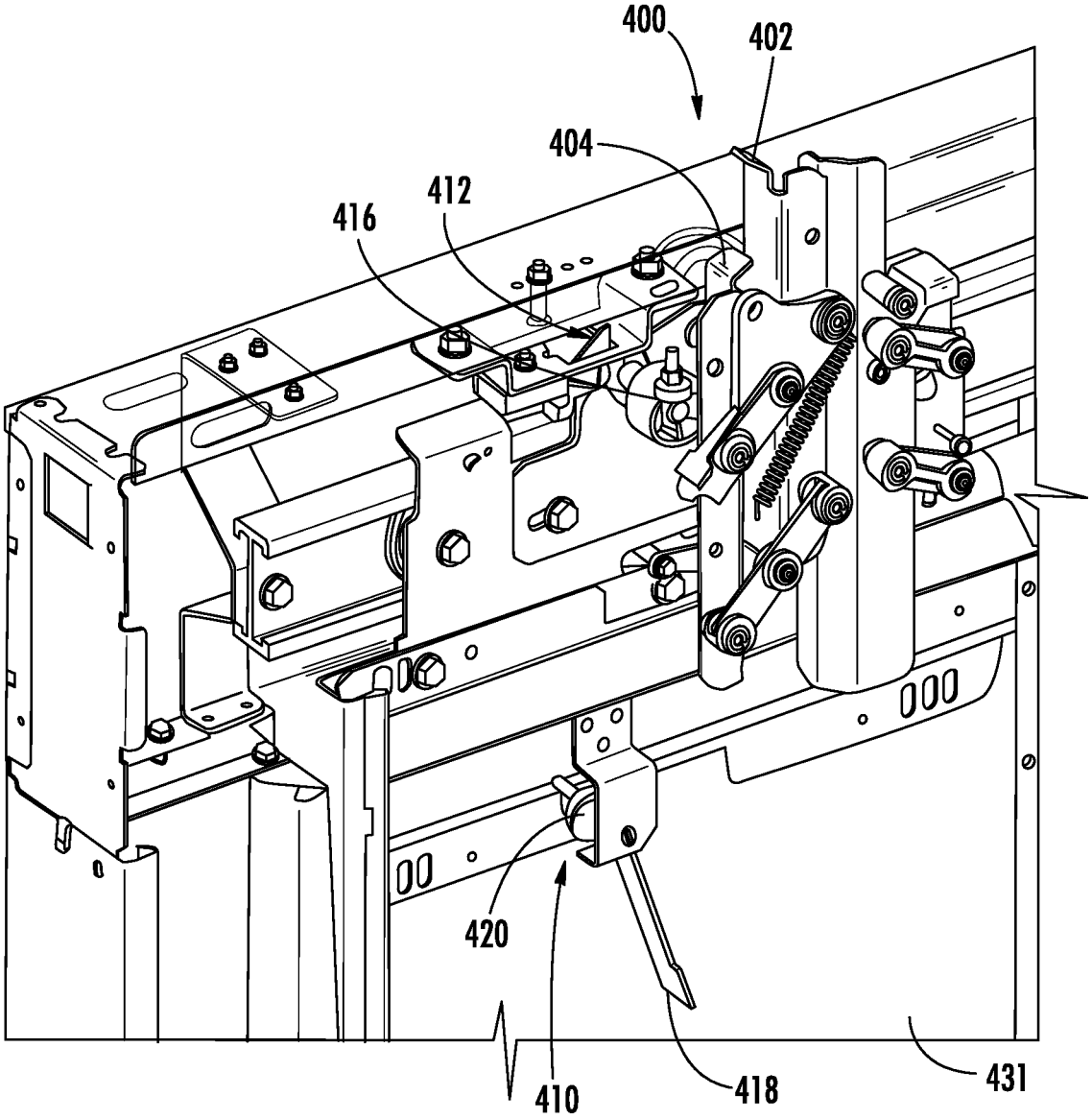
FIG. 4B is a schematic illustration showing a portion of an elevator car aligned with a landing and illustrating a first position of the elevator landing door lock assembly of FIG. 4A.
Figure 4C:
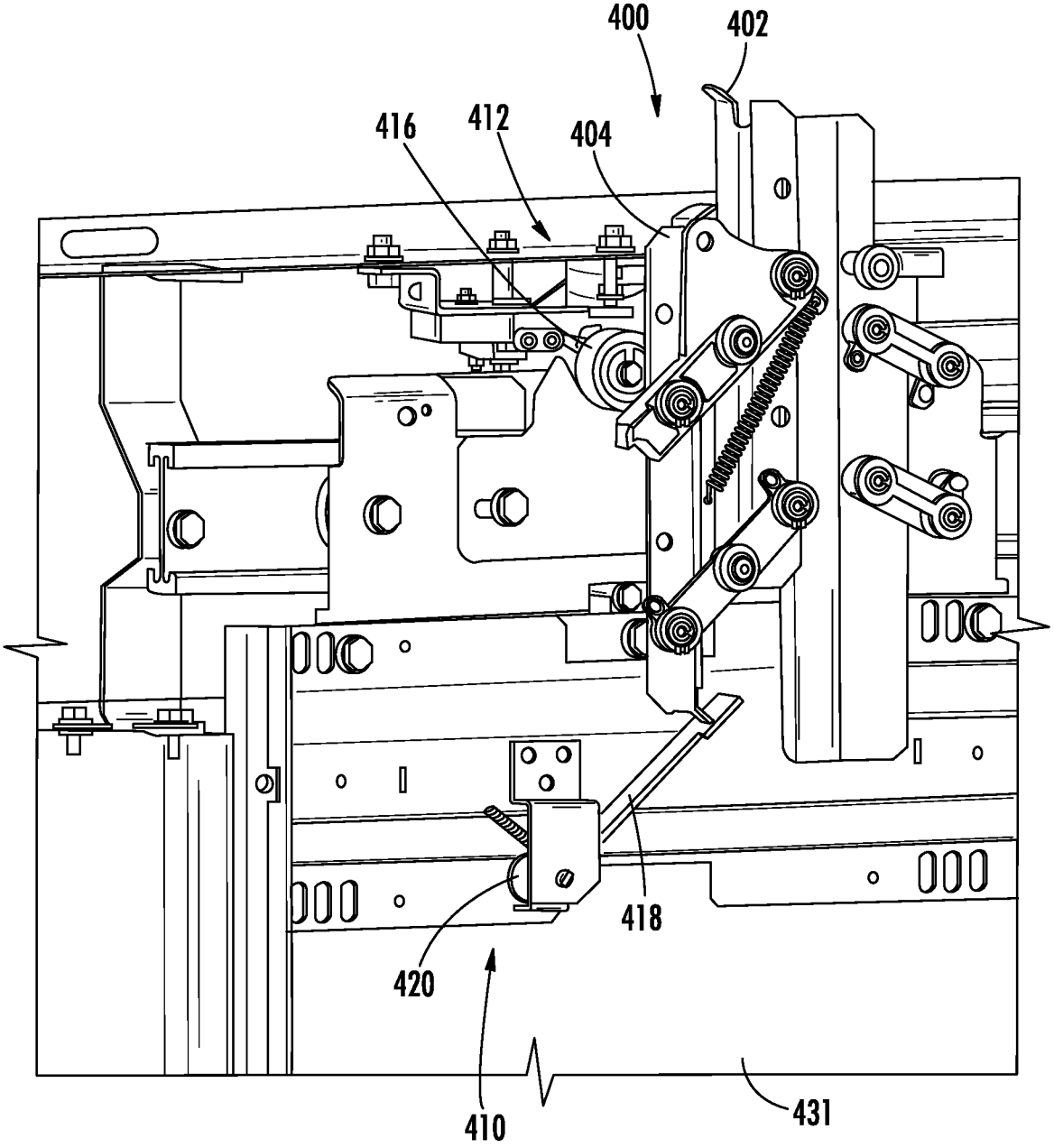
FIG. 4C is a schematic illustration illustrating a second position of the elevator landing door lock assembly of FIG. 4A engaged with a portion of an elevator car door coupling.
Figure 4D:
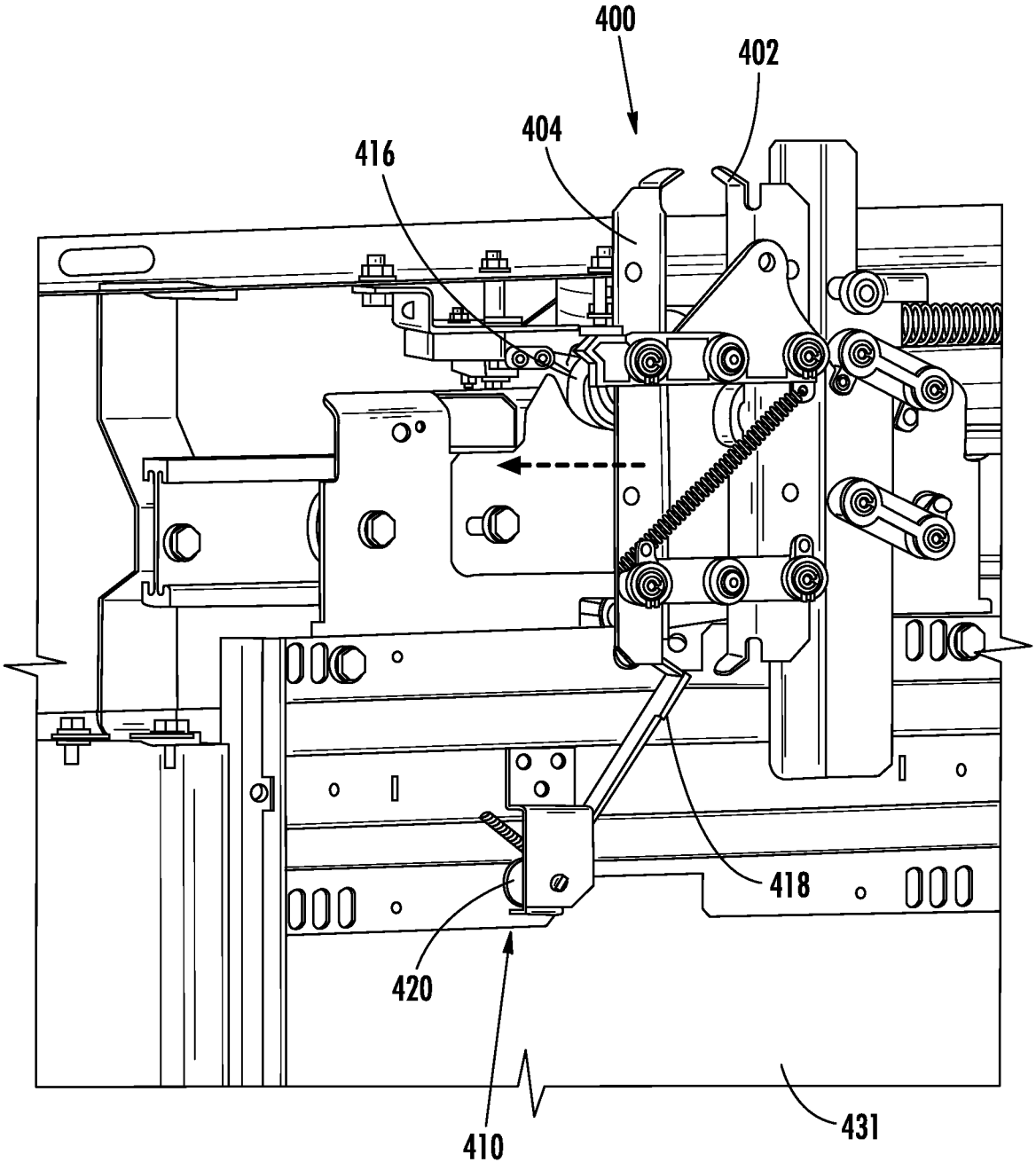
FIG. 4D is a schematic illustration illustrating a third position of the elevator landing door lock assembly of FIG. 4A engaged and urging the elevator car door coupling into an open position.

FIG. 4A is a schematic illustration of the elevator landing door lock assembly 410 as installed on an interior (i.e., elevator shaft) side of a landing door 431, without the presence of an elevator car aligned therewith. FIG. 4B is a schematic illustration of the landing door 431 with an elevator car aligned therewith, the elevator car having an elevator car door coupling 400. FIG. 4C is a schematic illustration showing partial actuation of the elevator landing door lock assembly 410 and interaction with the elevator car door coupling 400. FIG. 4D is a schematic illustration showing the elevator car door coupling 400 in an unlocked state as actuated by the elevator landing door lock assembly 410. In FIGS. 4B-4D, the elevator car is not shown for simplicity and clarity, but the elevator car door coupling 400 is mounted to or otherwise attached/connected to an exterior of an elevator car (and particularly exterior of an elevator car door).

With reference to FIG. 4A, the landing door 431 (or a panel thereof) has the elevator landing door lock assembly 410 attached thereto. The elevator landing door lock assembly 410 provides a keyway that is accessible from the landing, as will be appreciated by those of skill in the art. Also, shown in FIG. 4A, the landing door 431 is equipped with a landing door coupling 412. The landing door coupling 412, as shown, includes a landing door coupling support 414 having two rollers 416. The rollers 416 are positioned such that an elevator car can move freely within an elevator shaft without interfering with parts of the elevator car (e.g., an elevator car door coupling, etc.).

As shown, the elevator landing door lock assembly 410 includes a disengageable link 418, illustrated in FIGS. 4A-4D as an actuator arm. The disengageable link 418 is fixedly connected to a lock 420 which includes keyway. The disengageable link 418 is operably connected to the lock 420 (or a portion thereof, such as a keyway or cylinder) such that rotation of the lock 420 or a portion thereof (i.e., rotation of a key within the lock which turns a cylinder) urges the disengageable link 418 to also rotate. As shown, in the present embodiment, the disengageable link 418 is a lever arm that extends from the lock 420. Without an elevator car present, the elevator landing door lock assembly 410 cannot interact with either an elevator car door coupling or the landing door coupling 412, and thus the landings door 431 cannot be opened.

To enable opening of the landing door 431, the landing door coupling 412 must be actuated through interaction with an elevator car door coupling. Specifically, the rollers 416 must be engaged to thus enable unlocking and opening of the landing door 431.

Turning now to FIG. 4B, a portion of an elevator car is positioned in alignment with the landing door coupling 412. As shown, the illustrated portion of the elevator car is an elevator car door coupling 400. As described above and shown in FIG. 4B, the elevator car door coupling 400 includes a first vane 402 and a second vane 404. When the elevator car door (not shown) is aligned with the landing door 431, the elevator car door coupling 400 aligns with the landing door coupling 412 and the first and second vanes 402, 404 are positioned between the rollers 416 of the landing door coupling 412.

In normal operation, the elevator car door coupling 400 will be electrically or otherwise operated to spread the vanes 402, 404 into engagement with the rollers 416, which enables opening of both the elevator car door and the landing door 431. However, when power is not provided, manual operation of the opening mechanism is required (e.g., in emergency situations). Manual operation requires manual actuation of the elevator car door coupling 400 such that the vanes 402, 404 will engage with the rollers 416, which will enable opening of the landing door 431 and the elevator car door. In prior configurations, operation of a key could unlock the landing door without the presence of an elevator car (as noted above).

As shown in FIG. 4C, the disengageable link 418 is rotated such that the disengageable link 418 contacts one of the vanes 402, 404. Such contact is possible because the elevator car door coupling 400 is aligned with the landing door coupling 412. If the elevator car door coupling 400 was not present, rotation of the disengageable link 418 by operation of the lock 420 would not achieve any result (i.e., the disengageable link 418 would merely rotate but not contact anything).

However, when contact is achieved between the disengageable link 418 and a portion of the elevator car door coupling 400 (e.g., one of the vanes 402, 404), the elevator car door coupling 400 can be operated. That is, as shown in FIG. 4D, the disengageable link 418 can push on or otherwise urge the second vane 404 away from the first vane 402 such that the vanes 402, 404 contact the rollers 416. When the vanes 402, 404 contact and engage with the rollers 416, the landing door 431 and the elevator car door are unlocked and manual opening of the doors is enabled.

Although described herein with respect to a specific embodiment and configurations thereof, those of skill in the art will appreciate that alternative mechanisms, structures, features, processes, etc. can be employed to achieve similar operation and features. For example, generally speaking, embodiments of the present disclosure are provided to establish a temporary or transient link between a landing door locking device and an unlocking device for the landing door. Accordingly, embodiments provided herein break or separate the link such that the link is only established when an elevator car is present at the respective landing door. This is achieved by placing the missing link of the locking device on the elevator car. As such, it becomes necessary to have the elevator car in the door zone (i.e., at the landing) to operate the unlocking device of the landing door.

Advantageously, embodiments described herein provide elevator landing door lock assemblies that are configured to prevent opening of landing doors when no elevator car is present at the landing doors.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator landing door lock assembly comprising:

a lock having a keyway accessible from a landing of an elevator system, the lock operable to lock and unlock a landing door, the landing door having a landing door coupling with at least two rollers configured to operably engage with a first vane and a second vane of an elevator car door coupling of an elevator car, wherein when the elevator car door coupling is aligned with the landing door coupling the first vane and the second vane are positioned between the at least two rollers; and a disengageable link operably connected to the lock and configured to prevent unlocking of the landing door when the disengageable link is not engaged, wherein, when the elevator car is aligned with the landing door, the disengageble link is engaged and completed such that the lock is operable to unlock and open the landing door, and the disengageble link is configured to urge the second vane away from the first vane such that the first and second vanes of the elevator car door coupling contact respective rollers of the at least two rollers of the landing door coupling, and wherein, when the elevator car is not aligned with the landing door, the lock is not operable.

2. The elevator landing door lock assembly of claim 1, wherein the disengageable link is an actuator arm operably connected to the lock such that rotation of a key within the keyway actuates the actuator arm.

3. The elevator landing door lock assembly of claim 2, wherein actuation of the actuator arm urges a portion of the elevator car door coupling into contact with the landing door coupling to enable opening of the landing door.

4. The elevator landing door lock assembly of claim 2, wherein the actuator arm is a lever that contacts at least one of the first vane and the second vane of the elevator car door coupling.

5. The elevator landing door lock assembly of claim 2, wherein the actuation of the actuator arm comprises a rotational movement.

6. The elevator landing door lock assembly of claim 1, wherein the landing door coupling is positioned away from the lock and configured to operate through contact from a portion of the elevator car door coupling.

7. An elevator system comprising:

an elevator car located within an elevator shaft, the elevator car having an elevator car door coupling having a first vane and a second vane;

a landing having a landing door openable on the elevator shaft, the landing door having a landing door coupling having at least two rollers; and a landing door lock assembly comprising:

a lock having a keyway accessible from the landing and located within the elevator shaft; and a disengageable link operably connected to the lock and configured to prevent unlocking of the landing door when the disengageable link is not engaged, wherein, when the elevator car is aligned with the landing door, the first vane and the second vane are arranged between the at least two rollers, the disengageble link is engaged and completed such that the lock is operable to unlock and open the landing door, and the disengageble link is configured to urge the second vane away from the first vane such that the first vane and the second vane of the elevator car door coupling contact respective rollers of the at least two rollers of the landing door coupling, and wherein, when the elevator car is not aligned with the landing door, the lock is not operable.

8. The elevator system of claim 7, wherein the disengageable link is an actuator arm operably connected to the lock such that rotation of a key within the keyway actuates the actuator arm.

9. The elevator system of claim 8, wherein actuation of the actuator arm urges a portion of the elevator car door coupling into contact with the landing door coupling to enable opening of the landing door.

10. The elevator system of claim 8, wherein the actuator arm is a lever that contacts at least one of the first vane and the second vane of the elevator car door coupling.

11. The elevator system of claim 8, wherein the actuation of the actuator arm comprises a rotational movement.

12. The elevator system of claim 7, wherein the landing door coupling is positioned within the elevator shaft and away from the lock, the landing door coupling configured to operate through contact from a portion of the elevator car door coupling.

* * * * *